US006196171B1

(12) United States Patent
Melchior

(10) Patent No.: US 6,196,171 B1
(45) Date of Patent: Mar. 6, 2001

(54) LOOP-SCAVENGED TWO-STROKE INTERNAL COMBUSTION ENGINES

(75) Inventor: Jean Frederic Melchior, Paris (FR)

(73) Assignee: S.N.C. Melchior Technologie, Paris (FR)

( * ) Notice: Subject to any disclaimer, the term of this patent is extended or adjusted under 35 U.S.C. 154(b) by 0 days.

(21) Appl. No.: 09/125,207

(22) PCT Filed: Feb. 27, 1997

(86) PCT No.: PCT/FR97/00354

§ 371 Date: Feb. 10, 1999

§ 102(e) Date: Feb. 10, 1999

(87) PCT Pub. No.: WO97/32115

PCT Pub. Date: Sep. 4, 1997

(30) Foreign Application Priority Data

Feb. 28, 1996 (FR) ..... 96/02502

(51) Int. Cl.[7] ..... F01L 1/28
(52) U.S. Cl. ..... 123/65 VD; 123/79 C
(58) Field of Search ..... 123/65 VD, 79 C, 123/79 R, 90.12, 90.14, 65 V, 65 P

(56) References Cited

U.S. PATENT DOCUMENTS

| | | | | |
|---|---|---|---|---|
| 2,484,923 | * | 10/1949 | Anderson | 123/65 VD |
| 4,649,872 | * | 3/1987 | Solheim | 123/79 C |
| 4,815,422 | * | 3/1989 | Schaich | 123/79 C |
| 5,063,886 | * | 11/1991 | Kanamaru et al. | 123/65 VD |
| 5,555,859 | * | 9/1996 | Melchior et al. | 123/79 C |
| 5,782,215 | * | 7/1998 | Engelmann | 123/79 C |

FOREIGN PATENT DOCUMENTS

WO 95/08052 * 3/1995 (WO) .

* cited by examiner

*Primary Examiner*—Marguerite McMahon
(74) *Attorney, Agent, or Firm*—Larson & Taylor PLC

(57) ABSTRACT

A loop-scavenged two-stroke internal combustion engines with an intake valve (7) engaging a seat (10) for fresh air intake, and an exhaust valve (8) engaging a seat (13) for combustion gas exhaust, is disclosed. The valves are arranged in such a way that the fresh air intake scavenges a substantial part of the burnt gases. In at least one of the valves, the valve surface (21) located downstream from the valve face (9) and the surface (23) of the downstream extension of the seat (10) are configured in such a way that they form a substantially isentropic diffuser.

15 Claims, 7 Drawing Sheets

LOOP-SCAVENGED TWO-STROKE INTERNAL COMBUSTION ENGINES

FIELD OF THE INVENTION

The present invention concerns an improvement to two-stage internal combustion engines with loop scavenging of the type having at least one variable volume working chamber delimited by a cylindrical wall in which a piston slides, the mobile top face of the piston and a fixed cylinder head, operating in accordance with the two-stroke cycle, with a loop scavenging system via the cylinder head, controlled by at least one inlet valve cooperating with a seat, preferably of generally conical shape, to cause the working chamber to communicate cyclically with an inlet cavity communicating with means for supplying air to the engine and by at least one exhaust valve cooperating with a seat, preferably of generally conical shape, to cause the working chamber to communicate cyclically with an exhaust cavity communicating with the combustion gas exhaust system of the engine, and in which said inlet and exhaust valves are disposed so that the air entering the working chamber through the inlet valve causes scavenging of at least a substantial part of the burned gases in the chamber and their evacuation via the exhaust valve.

BACKGROUND OF THE INVENTION

In engines of the above type the difference AP in the gas pressure between the means supplying the engine with air at pressure P and the engine combustion gas exhaust system is relatively low and in practice is imposed by the specifications of the supercharged air supply means.

Scavenging can take place only during a limited part of each cycle, another and large part of the cycle being devoted to compression and expansion of the gases renewed in the chamber.

As a result the geometry and the operation of the inlet and exhaust valves play a decisive role in the efficiency, the power and the speed of the engine.

Increasing the size of the valves rapidly runs up against a geometrical limit imposed by the dimensions of the cylinder head while increasing the valve lift, that is to say the distance the valve moves away from its seat, and the lift speed, which are determined by the profile of the cams opening and closing the valves, is rapidly limited by mechanical constraints imposed by the permissible contact pressure between the nose of the cam and the components that it actuates.

This limits performance, i.e. the permeability of the cylinder head, the efficiency of use of the air passing through the cylinder head, i.e. the ratio between the mass of air enclosed in the working chamber at the end of scavenging to the mass of air passing through the cylinder head, and the scavenging efficiency, i.e. the ratio between the mass of air and the total mass of gas enclosed in said chamber at the end of scavenging.

Patent application EP-A-0 673 470 (or U.S. Pat. No. 5,555,859 or WO 95/08052) has made it possible to improve significantly on the above limitations by providing a single inlet valve and a single exhaust valve, said inlet and exhaust valves being coaxial circular cylinders, preferably coaxial with the cylindrical wall of the working chamber, the coaxial arrangement being such that the inlet valve is outside the exhaust valve, the seat of the inlet valve being attached to the cylinder head and oriented so that the pressure of the drive fluid contained in the working chamber exerts a force that tends to press said valve onto its seat, said seat being in the immediate vicinity of the periphery of the upper part of said cylindrical wall inside which the piston slides, and in contact with the cylinder head, said exhaust valve having a tubular part the inside wall of which slides on a fixed hub carried by the cylinder head, to which it is sealed by sealing means, and the end of which towards the chamber has a bearing surface coaxial with said tubular part so that it can cooperate with a seat provided inside the lower part at the same end of the chamber as said inlet valve, enabling communication of said exhaust cavity with the working chamber, by virtue of the annular space delimited radially by the inside wall of the inlet valve and by the outside wall of the exhaust valve.

This arrangement optimises and controls scavenging and doubles the actual lift of the exhaust valve because the inlet and exhaust valves lift in opposite directions.

If means are provided to cause the inlet air passing through the inlet valve to rotate, axi-symmetrical centrifugal layering can be achieved and the fuel can be injected into a hot central area that is relatively impoverished in oxygen, to obtain the advantages described in the above patent and in patent application FR-A-2 690 951.

BRIEF SUMMARY OF THE INVENTION

The present invention proposes to improve further the performance of engines having concentric inlet and exhaust valves, in particular as defined above, enabling a choice between reducing the scavenging time and consequently increasing the usable expansion stroke of the engine and therefore its efficiency, or, for a given angular duration of scavenging during the upward travel of the piston, a high permeability of the cylinder head enabling the rotation speed of the engine to be increased.

Another objective of the invention is to reduce significantly wear of the valves and their seat and in particular the inlet valve and its seat, the exhaust valve and its seat being generally better protected by the effects of lubrication by the carbon deposits caused by combustion gases moving towards the exhaust.

The invention consists in a two-stroke internal combustion engine with loop scavenging, preferably of the compression ignition type, of the kind described in the preamble, and preferably in which the inlet and exhaust valves are coaxial circular cylinders, preferably coaxial with said cylindrical wall, preferably with the inlet valve outside the exhaust valve, and preferably having the other features of the valves of concentric valve engines of the type described hereinabove, characterised in that, for at least one of said inlet and exhaust valves the surface of the valve downstream of the bearing surface of said valve, in the direction of flow through it, on the one hand, and the surface of a part extending the seat of said valve, with which said bearing surface cooperates, and also situated downstream of said seat, on the other hand, are configured to constitute a substantially isentropic diffuser discharging into the cavity downstream of the valve.

"Isentropic diffuser" means a divergent nozzle in which the flow of gas through the nozzle is slowed and compressed virtually isentropically.

The outlet into said downstream cavity has a discharge section greater than the geometrical flow section of the valve in the fully open position between the bearing surface of said valve and its seat.

"Geometrical flow section of the valve" means the minimum unrestricted flow section between the lifted valve and its seat. This section remains in the vicinity of the bearing surface, i.e. the areas of contact between the closed valve and its seat, but its axial position can vary with the lift of the valve.

Accordingly, flow downstream of the valve is effected in a diffuser whose section increases progressively, at least on approaching the cavity downstream of the valve, i.e. the working chamber in the case of an inlet valve and the exhaust cavity in the case of the exhaust valve, the discharge section of the diffuser, i.e. the section through which the diffuser opens into said cavity, being greater than the flow section of the valve in the fully open position between the bearing surface of the valve and its seat.

In a preferred embodiment, the ratio between the discharge section where the flow from the valve enters the cavity downstream of the latter, in the direction of flow, and said geometrical flow section of the valve in the fully open position is at least equal to the critical ratio calculated for the value of the ratio of the pressures of the fluid flowing in said valve on either side of the latter during normal operation of the engine.

The critical ratio is defined as that for which the speed of the flow reaches the speed of sound at the throat of the fluid flow in the vicinity of the valve bearing surface; it can easily be calculated using the equations of isentropic diffusion.

If the valve forming the diffuser is a tubular inlet valve opening into a cylindrical chamber, the surface profile of the valve downstream of its bearing surface is preferably configured so that it progressively becomes substantially parallel to the direction of the cylindrical wall of the chamber in which the piston slides.

The bearing surface of the inlet valve, in conjunction with the seat, can then advantageously define an angled path progressively widening in the meridian plane and with advantage initially oriented outwards, i.e. towards the wall of the chamber, so as progressively to become parallel to the wall of the chamber.

In the case of a tubular exhaust valve the profile of a part of the valve downstream of its bearing surface is preferably configured at its outlet so as to be substantially parallel to the interior cylindrical part of the inlet valve that forms the seat of the exhaust valve.

In a preferred embodiment deflector means are provided in the air supply passage that delivers air to the tubular inlet valve to impart to the flow of air a rotary component so as to send through the flow area of the valve and then the part forming the diffuser a substantially isentropic flow of air with a rotary movement procuring a centrifugal effect tending to hold the air against the wall of the cylindrical chamber in which the piston slides to obtain the advantages described in patent application FR-A-2 690 951.

The access passages to the inlet valve are preferably inclined to the geometrical axis of the cylinder at the exit from said inlet cavity and towards the piston to reduce deflection of the flow in a meridian plane in order to minimise head losses.

Deflector means such as fixed deflector blades can be disposed either in these passages or even on the inlet valve itself, if necessary. By increasing the effective permeability of the cylinder head by virtue of the isentropic diffusion of the flow, the invention limits the disadvantageous head loss that inevitably results from the rotation imparted to the air by the deflector means, which are generally inclined at an angle near 45°.

The invention also consists in an engine as defined in the preamble preferably including a tubular inlet valve having a bearing surface that is preferably generally conical in shape cooperating with a valve seat carried by the cylinder head, the bearing surface of the valve bearing on the seat along a circular line in a plane perpendicular to the axis of translation of the valve, characterised in that the valve and the seat downstream of said circular line of bearing engagement between the bearing surface and the seat as defined when the pressure in the chamber is low or nil are adapted so that on the occasion of cyclic deformation of the valve by forces due to the pressure of the gases the diameter of the circular line of contact decreases so that the bearing surface of the valve pivots about its bearing engagement with its seat and rolls without sliding on the latter.

The deformation of the valve due to the action of the pressure of the gases can then be exploited with advantage to prevent sliding leading to wear of the bearing surface of the valve by achieving an effect of rolling against the surface of the seat, by virtue of the deformation of the valve, when the pressure increases as a result of compression and then combustion.

This rolling contact without sliding is possible only because of the hollow structure of the valve on each side of the line of contact.

To achieve this result the conjugate surface at the bearing surface and preferably also the surface at the seat advantageously have profiles having a point of inflection, the line of contact, i.e. of bearing engagement, moving in the vicinity of this point of inflection when the pressure varies.

With surfaces of the above kind, for example S-shape surfaces, when the valve is not loaded by the pressure, or only slightly loaded, the line of contact is below the point of inflection. When the valve is highly loaded, when the gases are at the maximal pressure, for example, it is on or slightly above the point of inflection.

The conjugate surfaces are preferably adapted to form, downstream of the bearing surface and the seat in the direction of flow of the fluid, a diffuser procuring substantially isentropic flow as defined hereinabove.

BRIEF DESCRIPTION OF THE DRAWINGS

Other advantages and features of the invention will become apparent on reading the following description given by way of non-limiting example and referring to the appended drawings, in which:

In FIG. 3 the inlet valve is open and the exhaust valve is slightly open. In FIG. 4 both valves are maximally open;

DETAILED DESCRIPTION OF THE INVENTION

Figure 1:
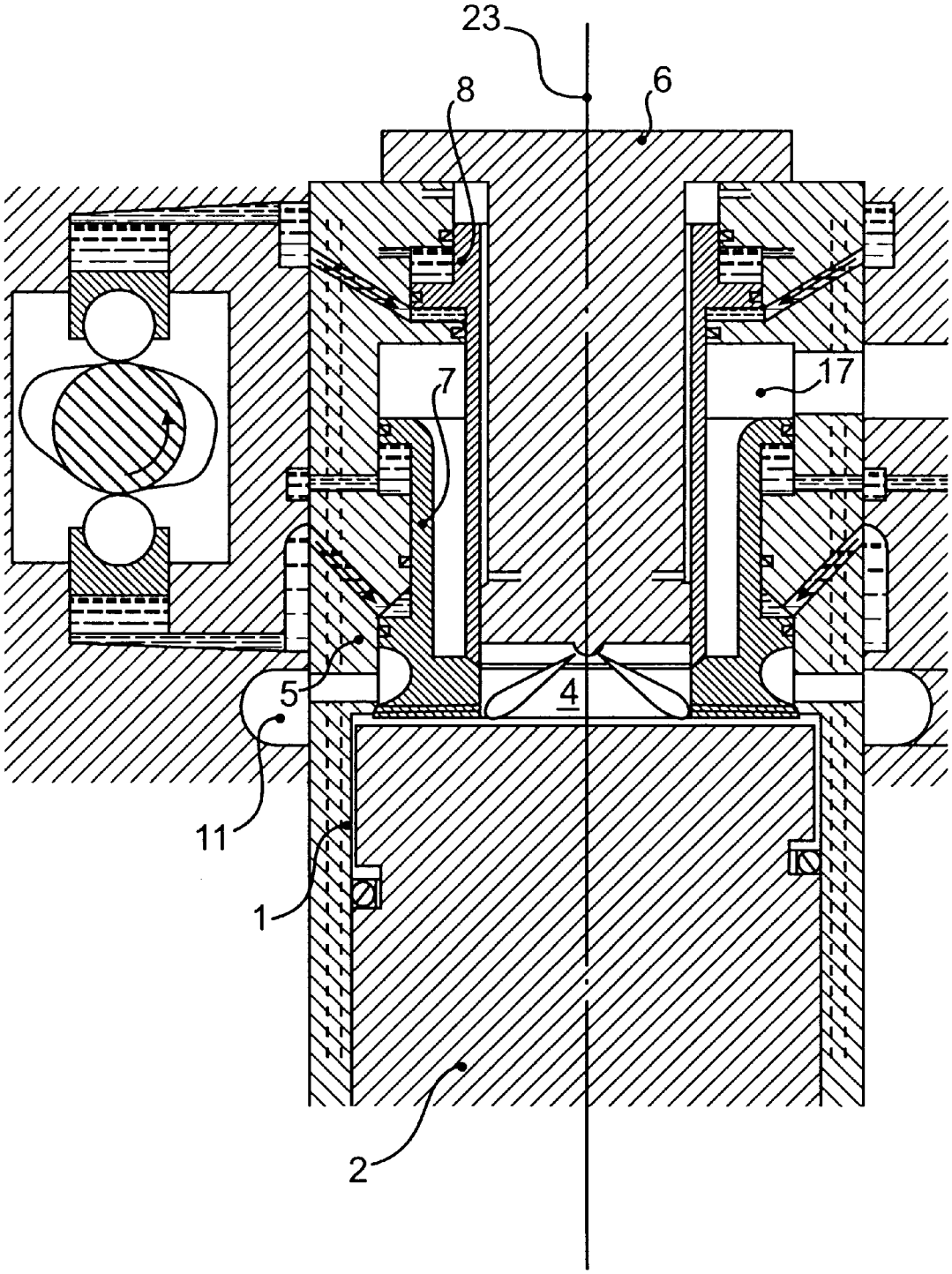
FIG. 1 PRIOR ART
FIG. 1 represents a schematic view in axial section of a prior art engine shown with the inlet and exhaust valves closed and the piston at top dead centre while combustion is taking place in the working chamber.
Figure 2:
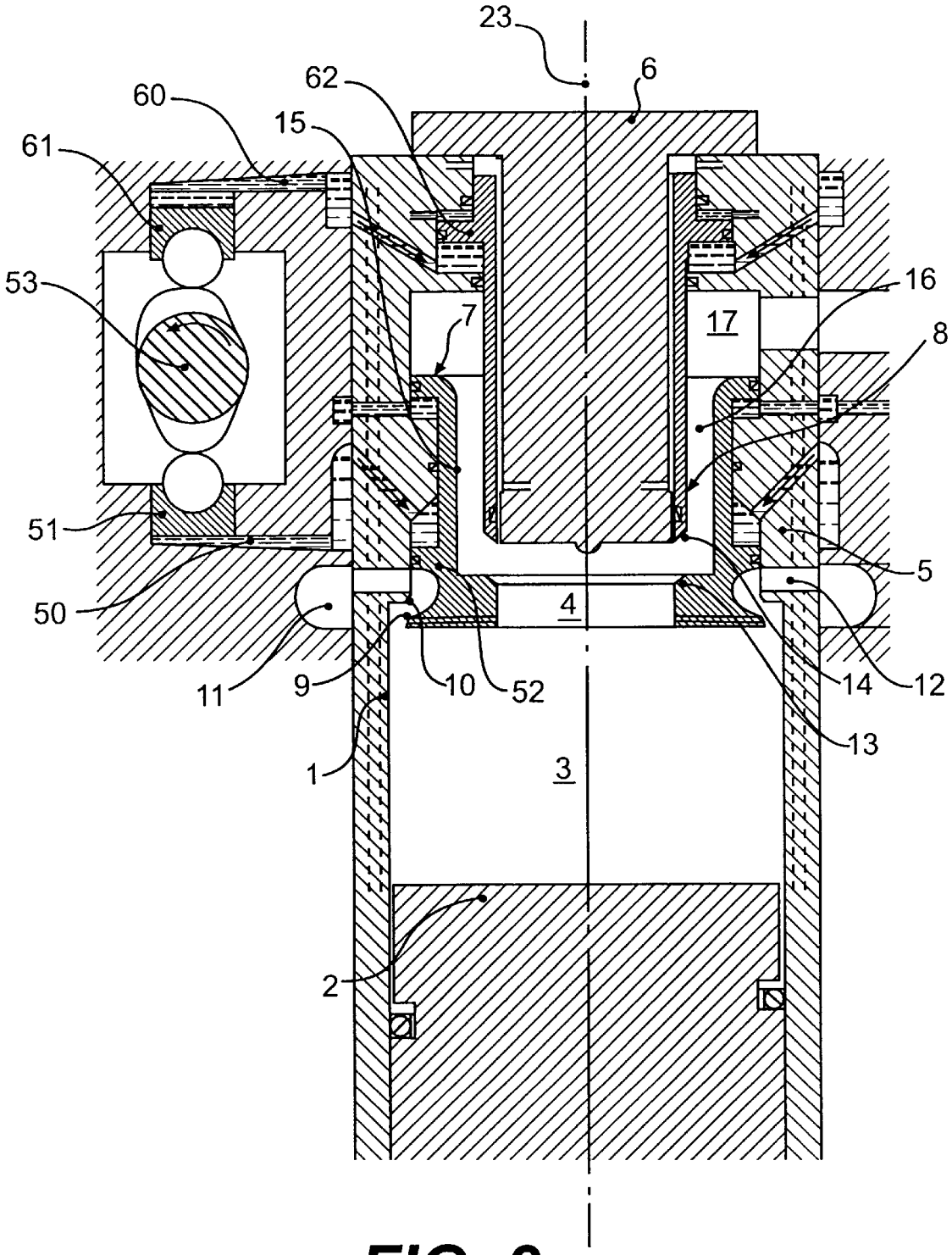
FIG. 2 PRIOR ART
FIG. 2 represents a schematic view in axial section identical to FIG. 1 but with the valves in the maximally open state and the piston near bottom dead centre while the working chamber is being scavenged.

Refer first to FIGS. 1 and 2.

The prior art engine described in application EP-A-0 673 470 is a two-stroke diesel engine with loop scavenging comprising a cylinder 1 in which slides a piston 2 and which is closed at the top by a cylinder head 5.

The cylinder, the piston and the cylinder head delimit a variable volume working chamber 3 in which combustion takes place when the piston is near top dead centre, as shown in FIG. 1.

The cylinder head 5 has a circular cylindrical fixed central hub 6 attached to it the axis 23 of which is preferably coincident with that of the cylinder and the piston and inside which there is a fuel injector, not shown, on the axis of said hub and discharging along the axis of the combustion chamber 4 forming part of the working chamber 3.

The engine also includes a generally tubular inlet valve 7 and a generally tubular exhaust valve 8, said valves being concentric along the common axis 23 and the exhaust valve being inside the inlet valve. The inlet valve 7 has at the bottom a bearing surface 9 cooperating with a seat 10 formed in the lower part of the cylinder head 5. Concentric with and outside this bearing surface, an inlet cavity 11 distributes air to the valve from a conventional air supply device (not shown). The cavity 11 advantageously communicates with the inlet valve 7 via passages 12 oriented to impart to the inlet air flow a rotation component about the common geometrical axis 23 of the various components of the engine.

These passages can be delimited by two coaxial conical surfaces in the cylinder head, fixed deflector blades being disposed as close as possible to the exit into the working chamber.

The tubular inlet valve 7 has a circular cylindrical inside surface, preferably with a conical surface in its lower part coaxial with the axis 23 of the valve and forming a seat 13 that cooperates with the bearing surface 14 of the tubular exhaust valve 8.

The tubular inlet valve 7 also has a cylindrical tubular body 15 which slides in a bore in the cylinder head 5. The tubular exhaust valve 8 also has a cylindrical tubular body which slides on the fixed central hub 6. Oil passages are formed between the inside cylindrical surface of the body of the exhaust valve 8 and the outside cylindrical surface of the fixed central hub 6 to enable cooling and lubrication of the facing components.

Because of their different diameters, the two coaxial circular tubular valves delimit an annular passage 16 through which the exhaust gases are conducted from the working chamber 3 to the exhaust cavity 17 which communicates with the exhaust system, not shown, of the engine.

The two valves 7 and 8 are operated hydraulically, as described in application EP-A-0 673 470, by virtue of cyclic variations in the pressure of a hydraulic liquid enclosed in two cavities 50 or 60 of constant volume but having variable surface areas delimited by a drive piston 51 or 61 cooperating with a camshaft 53 coupled to the main shaft of the engine and by a receiving piston 52 or 62 respectively attached to the inlet valve and the exhaust valve, and which includes adequate return spring means.

The receiving pistons 52 and 62 are disposed so that the inlet and exhaust valves are actuated in opposite directions, the tubular inlet valve 7 opening downwards, i.e. towards the piston, and the tubular exhaust valve opening upwards.

With the bearing surface 14 of the exhaust valve cooperating with its seat 13 on the inside surface of the inlet valve, and with the two valves moving in opposite directions, the opening of the exhaust valve is clearly increased by the lift of the inlet valve.

An engine of the above type operates in the following manner:

When the piston 2 is propelled towards bottom dead centre by the gases in the working chamber after combustion of the fuel, and therefore at the end of expansion of the working chamber, the exhaust valve is opened to enable the pressure in the working chamber to fall below the pressure in the inlet cavity 11 ("exhaust puff") to prevent the gases flowing back towards the inlet circuit ("counter-scavenging"). The inlet valve is then opened to scavenge the working chamber, which consists in substituting air for the combustion gases.

The inlet air enters the flow section of the inlet valve delimited between the bearing surface 9 and the seat 10, having had rotation imparted to it previously in said passages 12. The air therefore enters the working chamber in the space delimited by the lateral wall of the cylinder and the lower part of the valve. Because of the rotation of the air about the axis 23, the air streams entering the working chamber are inclined to said axis 23, forming a layer of air along the cylindrical wall moving towards the piston and rotating about this axis.

At the same time the hot gases which are concentrated near the axis of the chamber 3 and of the combustion chamber 4 escape via the flow section between the seat 13 and the bearing surface 14 of the exhaust valve. During the first phase of the upward movement of the piston 2 the combustion gases are therefore largely evacuated and replaced by air. In the second part of the upward movement of the piston 2 the valves are closed and all of the gases contained in the chamber 3 are then progressively compressed to the state of maximum compression in the combustion chamber 4 into which fuel is then injected under pressure, which ignites the fuel and starts a new engine cycle.

The times at which the valves close can advantageously be adjusted to obtain inside the available volume above the piston 2 a mass of air that is rotating and therefore centrifuged towards the periphery and surrounding a smaller mass of hot combustion gas in the central part, from the previous cycle and retained in the chamber during scavenging, with the result that injection takes place into this central part, which will procure the advantages described in patent application FR-A-2 690 951.

Figure 3:
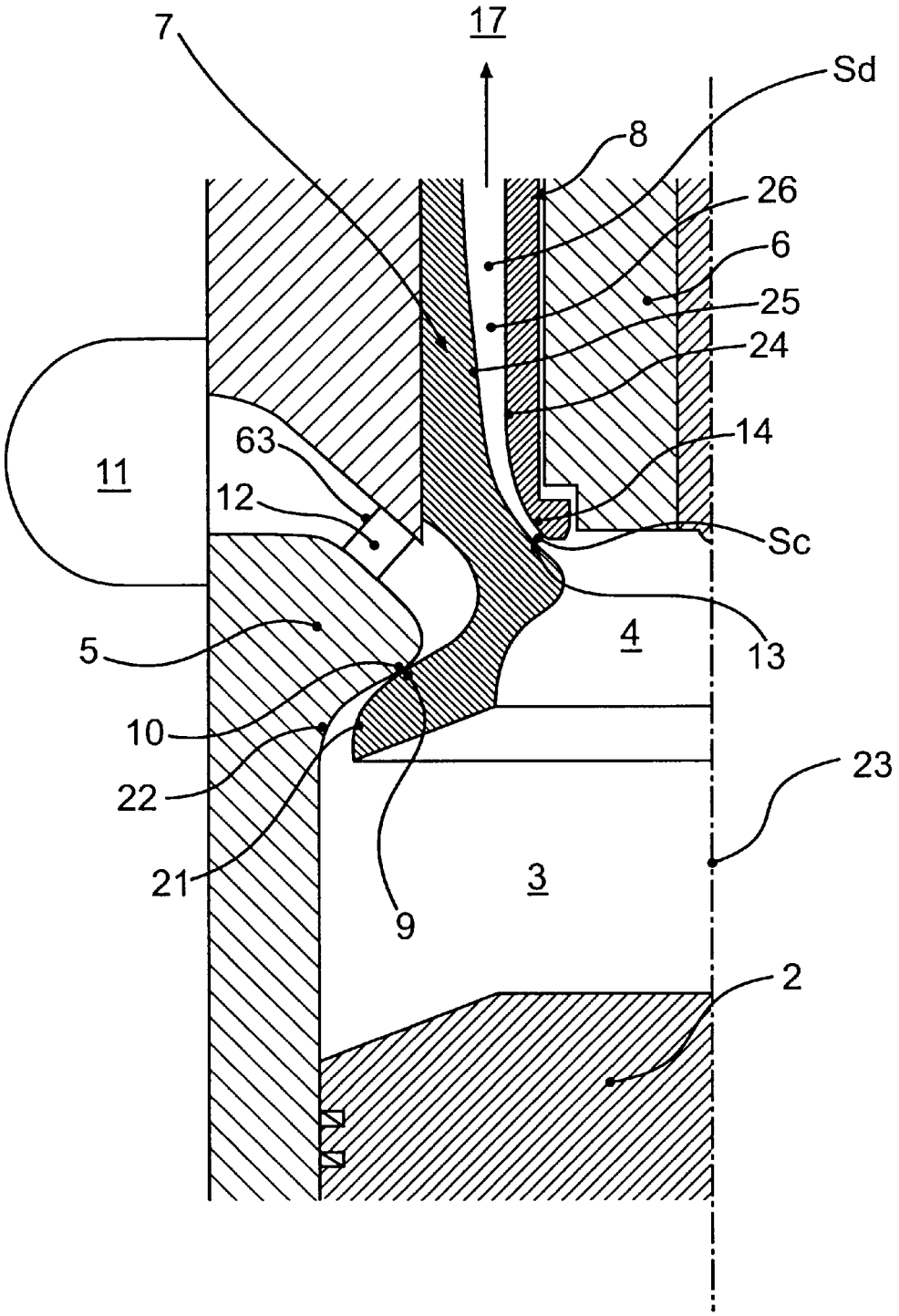
FIGS. 3 and 4 represent a schematic view of the geometrical shapes of inlet and exhaust valves with their respective seat designed in accordance with the invention to enable flow through them to diffuse isentropically downstream of their respective throats, i.e. downstream of the maximal constriction of the passage available to said flow.
Figure 4:
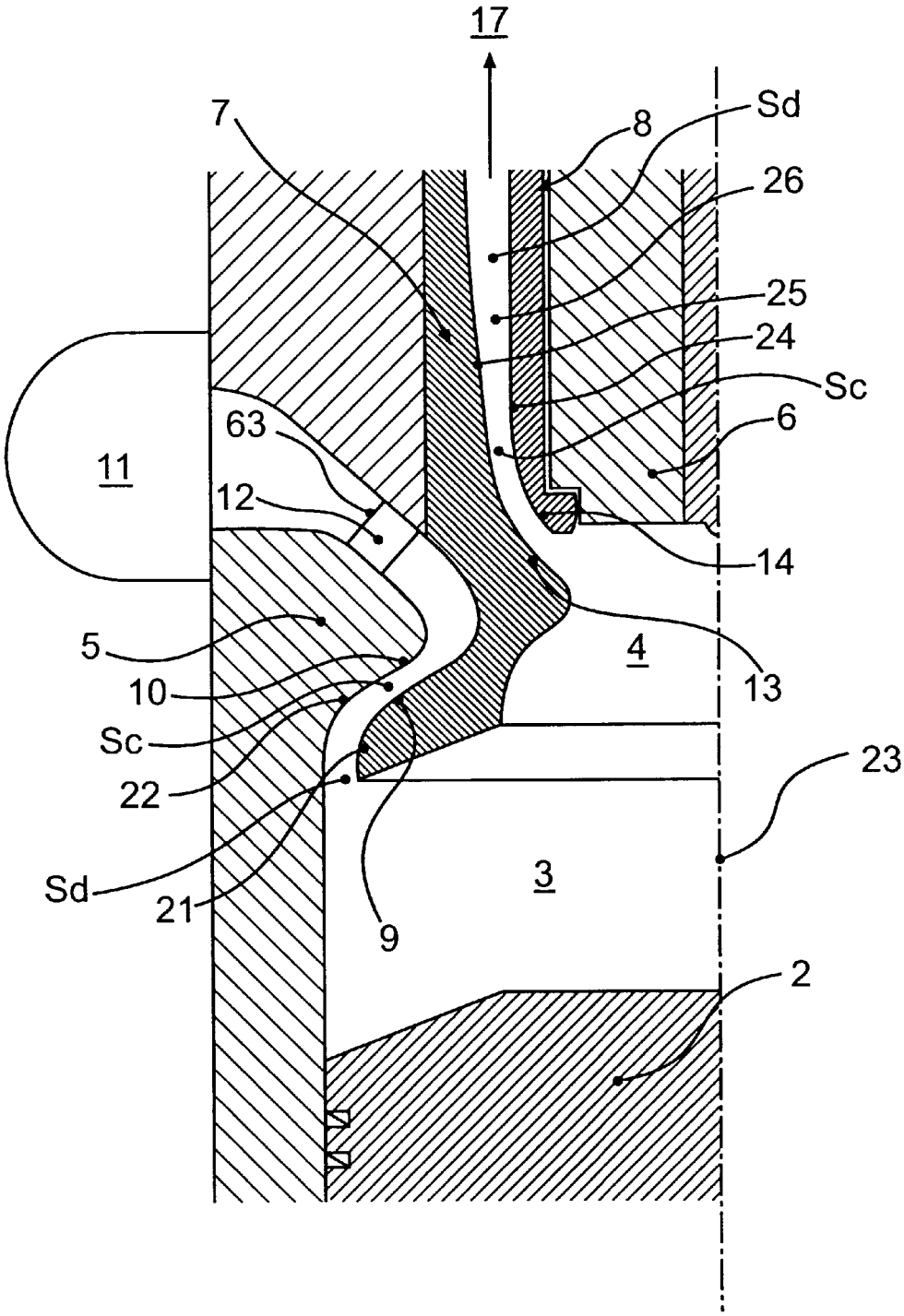

In accordance with the invention, and as shown in FIGS. 3 and 4, the lower part of the tubular inlet valve 7 downstream of the bearing surface 9 cooperating with the conical seat 10 (in the direction of flow of the air through it) is extended downwards, i.e. towards the piston, by a skirt 21 having symmetry of revolution and coaxial with said valve, the outside surface of which, i.e. the surface at the greatest distance from its axis 23, is a circular cylindrical surface the meridian profile of which merges at the upstream end tangentially with the surface of the bearing surface 9. At the downstream end it preferably terminates parallel to the axis 23.

In the same manner the conical seat 10 is extended regularly by a circular cylindrical surface 22 around the axis 23 the meridian profile of which is tangential—at the upstream end—to the conical seat and parallel—at the downstream end—to the axis 23.

The facing circular surfaces 21 and 22 therefore delimit an annular passage having symmetry of revolution and the discharge section of which increases regularly from the minimal flow section Sc (with the valve in the maximally open position) called the throat of the valve and in line with the seat 10 and the bearing surface 9 to the maximal flow section Sd at the bottom of the skirt 21.

In accordance with the invention, the meridian profiles of the facing surfaces 21 and 22 are designed to constitute an "isentropic diffuser" when the valve is in the fully open position. By "isentropic diffuser" is meant a passage whose flow section, increasing in the direction of flow, is such that the flow through it, having been previously accelerated and expanded until it passes the throat of the valve, is there decelerated and recompressed quasi-isentropically [i.e. with no thermal losses at the wall and with conservation of the total pressure (cut-off pressure) all along the flow], to the static pressure downstream of said valve.

The progressive increase in the flow section in the diffuser must be neither too small—because friction at the walls would then become excessive, leading to a drop in the total pressure of the flow—nor too large—because the flow then separates from the wall, also leading to a drop in the total pressure. For a conical diffuser, for example, the optimal angle characterising the progressive increase in the flow section is known to be around 7° to the axis of said cone.

An arrangement of the above kind has the following advantages:

The flow, which is deflected relative to the axis of the cylinder on passing through the throat of the valve, is regularly straightened so as to be directed parallel to the axis of the cylinder towards the piston (with a tangential component, if momentum is imparted to this flow on passing said valve).

For a given pressure different AP between the inlet cavity and the cylinder, the value of which depends on the efficiency characteristics of the turbocharger, and a given temperature T and a given pressure P in the inlet cavity 11, the flowrate Q through the valve is increased in the ratio $S_d/S_c$ of the maximal discharge section $S_d$ at the exit from the diffuser to the minimal section $S_c$ at the throat relative to the flowrate Q* that would pass through the same valve without its diffuser.

The increase in the flowrate is nevertheless limited by the fact that, expanding on passing through the throat of the valve, the flow is accelerated and is then recompressed and decelerates in the diffuser. However, for a given section at the throat (determined by the geometry and the maximal lift of the valve) there is a maximal value of the outlet section $(S_d)_m$ of the diffuser for which the speed of the flow at the throat of the valve reaches the speed of sound. If the exit section of the diffuser were greater than this critical section $(S_d)_m$ the flow would separate from the wall beyond said critical section and there would no longer be an isentropic diffusion of the flow beyond the critical section and consequently no increase in the flowrate through the valve.

The critical section of course depends on the expansion ratio $\omega=P(P-\Delta P)$ between the inlet cavity and the cylinder. The theoretical expression for this quantity is:

$$[S_c/S_d]_{critical}=\{2/(\gamma-1)\cdot[(\gamma+1)/2]^{(\gamma+1)/(\gamma-1)}\cdot\omega^n\cdot(\omega^n-1)\}^{1/2}/\omega$$

with: $n=(\gamma-1)/\gamma$ and $\gamma=C_p/C_v$ $C_p$ and $C_v$ being the specific heats at constant pressure and at constant volume of the gaseous fluid concerned.

For example: $\gamma=1.404$:

| $\Delta P/P$ | $[S_d/S_c]_{critical}$ |
|---|---|
| 0.05 | 2.228 |
| 0.10 | 1.622 |
| 0.15 | 1.366 |
| 0.20 | 1.222 |

This means that the flow through the valve of the invention can be increased 62% relative to a conventional valve if the pressure difference on either side of the valve is 10% of the total upstream pressure. On the other hand, there is no point in increasing the exit section of the diffuser beyond this critical ratio, as the flow would then be stuck at the speed of sound on passing through the throat of the valve.

The diffuser is said to be matched to the throat of the valve if the speed of sound is reached at said throat and if the flow diffuses reversibly, i.e. without separating from the wall, as far as the exit section.

Thus if the diffuser is matched to the valve in the fully open position (with a discharge section increased 62% relative to the section at the throat if the pressure difference across the valve is 10% of the pressure upstream of the valve) it would clearly not be matched for smaller lifts of the valve. If the valve is lifted halfway, for example, the flow will separate from the wall of the diffuser in the section of the diffuser whose flow section is equal to half its exit section. However, the facing profiles 21 and 22 can be organised so that the diffusion is as near perfect as possible even during lifting of the valve. This considerably increases the velocity of the flow at the throat and this considerably increases the effective permeability of the inlet valve for a pressure difference between the inlet pressure due to the supercharging means and the pressure in the exhaust, which remains constant. The flow of air entering via the inlet valve is therefore considerably increased.

It should also be pointed out that the diffuser is extremely efficient, including at the instant the inlet valve begins to move away from its seat and the flow area at the level of the seat is still very small. The efficiency, i.e. the increase in permeability, is immediately obtained, even at low engine operating speeds and when starting the engine, in other words at time when, in the conventional arrangement, scavenging is most difficult.

Likewise, in the exhaust valve of the invention, as represented in FIGS. 3 and 4, the circular cylindrical surfaces constituting the inside wall 25 of the inlet valve and the outside wall 24 of the exhaust valve, situated downstream of the bearing surface 14 of the exhaust valve and the seat 13 of said valve formed on the inside wall of the tubular inlet valve, delimit an annular passage 26. The meridian profiles of these facing surfaces 24 and 25 are designed so that the annular passage 26 constitutes a divergent passage from the minimal section Sc at the throat of the valve to the maximal value Sd where it joins the exhaust passage 17 and so that this divergent passage is an isentropic diffuser in the sense defined above.

Similarly, the ratio between the exit section Sd of the diffuser and the section Sc at the throat of the valve in the fully open position is preferably at most equal to the critical ratio calculated for the nominal value of the relative pressure difference across the valve.

The position of the throat of the valve, defined by the minimal geometrical flow section of the annular passage, can vary relative to the position of the bearing surface 14 and the seat 13 of said valve and in accordance with the degree to which the valve is open.

In FIG. 3, for example, in which the exhaust valve is shown slightly open, it can be seen that the throat of the valve, with the minimal flow section Sc, is in the immediate vicinity of the bearing surface 14 of the valve and its seat 13.

In FIG. 4, on the other hand, which shows the two valves in the fully open position (and with the flow section of the valve increased because of the downward movement of its seat 13 on the inlet valve), it can be seen that the position of the throat of the valve of minimal section Sc is well above its bearing surface, in the rectilinear part of the annular passage, which is highly favourable to obtaining good diffusion of the flow (it is well known that it is particularly difficult to obtain perfect diffusion in a curved passage).

The skilled person can determine conjugate profiles 21 and 22 for the inlet valve and 24 and 25 for the exhaust valve either by calculation or by experiment. The profiles are preferably designed so that the divergent passage following on from the throat of the valve constitutes as near perfect as possible an isentropic diffuser, in the sense defined above, when the valve concerned is in the fully open position. To determine the ideal profile it is necessary to take into account the fact that the flow has an axial component ("discharge velocity") and a tangential component imparted to it on passing the deflector means such as blade 6.

Figure 5:
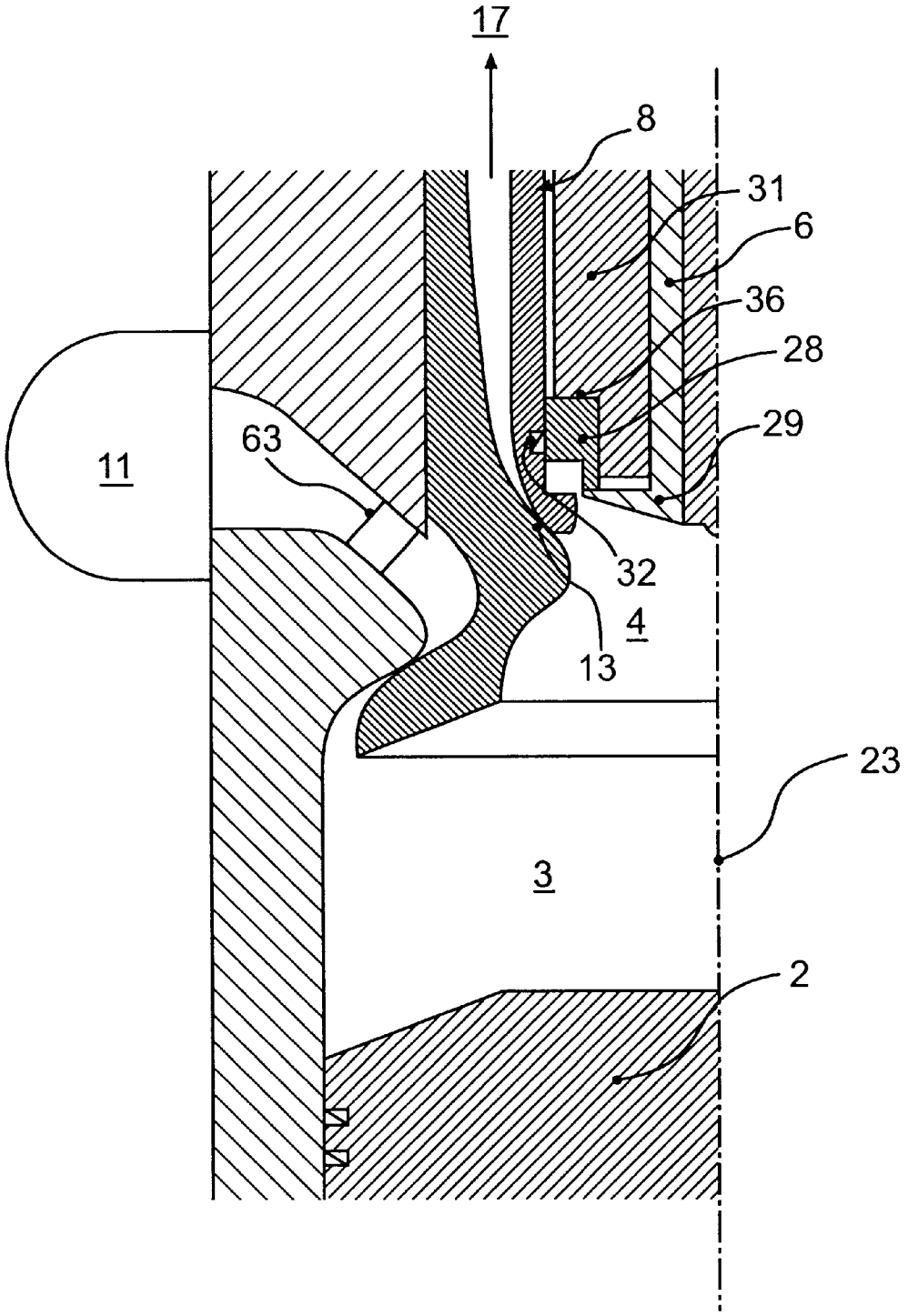
FIG. 5 represents a schematic view of the lower part of the exhaust valve with a floating ring disposed between its inside surface and the hub.

Refer now to FIG. 5.

The inlet valve has a large diameter and centres naturally, when closed, on its seat on the cylinder head. The smaller diameter exhaust valve bears on the conical seat 13 on the inlet valve and can therefore be off-centre by a non-negligible amount relative to the central hub 6 on which it slides. In the case of large bore engines, given the tolerances for the manufacture and stacking of the parts, this eccentricity can be as much as several tenths of a millimeter.

Under these conditions, to assure a good seal between the inside cylindrical surface of the exhaust valve 8 and the outside surface of the central hub 6, a floating ring 28 can advantageously be fitted that is able to move laterally relative to the hub. The floating ring 28 can be accommodated in such a fashion as to be able to move laterally with a small clearance in a groove formed between a shoulder 29 on the hub 6 and a counter-shoulder 36 on a part 31 which is also part of the hub 6, the outside cylindrical surface of the ring 28 providing a sliding track for a sliding seal or packing 32 in the lower inside part of the exhaust valve 8. The sliding track obviously has an outside cylindrical surface of sufficient height to enable sliding of the packing 32 throughout the lifting of the exhaust valve.

Figure 6:
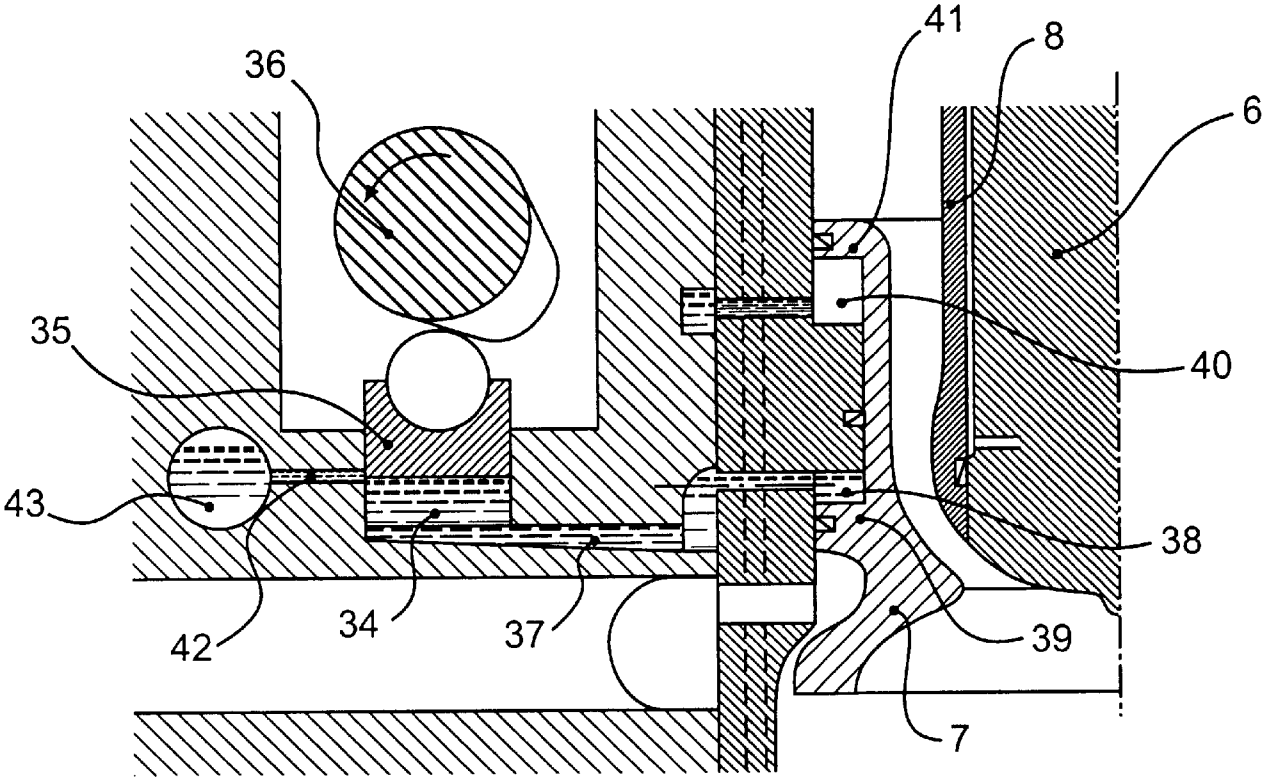
FIG. 6 represents a schematic view of the inlet valve actuating means.

Refer now to FIG. 6.

Any known valve actuation means can be used to actuate the valves, for example the inlet valve 7, such as mechanical actuation by a camshaft, for example, or electromagnetic actuation synchronised with rotation of the main shaft of the engine. In any event, hydraulic actuation means can advantageously be used, as in patent application EP-A-0 673 470, which consist in a deformable cavity of constant volume filled with a hydraulic liquid such as the lubricating oil of the engine, for example, and having a first chamber 34 of variable volume delimited by a cylinder head and in which slides an actuator piston 35 cooperating with a camshaft 36 coupled to the main shaft of the engine and which communicates via a passage 37 with a second chamber 38 of variable volume delimited by the bore in which the cylindrical outside surface of the inlet valve 7 slides, which has a shoulder 39 serving as a receiver piston so that when the nose of the cam 36 actuates the drive piston 35 the oil, deemed to be an incompressible liquid, expelled through the passage 37 from the first chamber 34 into the second chamber 38, causes the receiver piston 39 to descend and thereby the valve 7 to be opened. Return movement in the upward direction can be effected by return means, for example a spring or preferably pneumatic return means consisting of the compression of the air contained in a cavity 40 one face of which is also delimited by a shoulder 41 of the valve 7 acting as a return piston surface. If the volume formed by the cavities 34 and 38 and the passage 37 is too full of oil, for example after an oil leak into the cavity or thermal expansion of the oil, the valve will not drop back onto its seat. If there is insufficient oil, for example through leakage to the exterior, contact between the cam 36 and the roller of the piston 35 will be interrupted, which will cause impacts in the actuating means.

The invention avoids these drawbacks by means of an automatic device for taking up clearance providing a small diameter passage 42 that can discharge into the cavity 34 and is connected to the low-pressure oil supply means 43, the outlet from the narrow passage 42 into the chamber being disposed so that it is cyclically covered and uncovered by the movement of the piston 35, its location being such that, when the piston 35 with its roller is released to return to its initial position after actuation by the cam 36, the outlet is uncovered and places the cavity filled with oil in communication with said low-pressure oil supply means 43, whereas it is very quickly covered when the piston 35 begins to be moved downwards by the cam to start lifting the valve.

Figure 7:
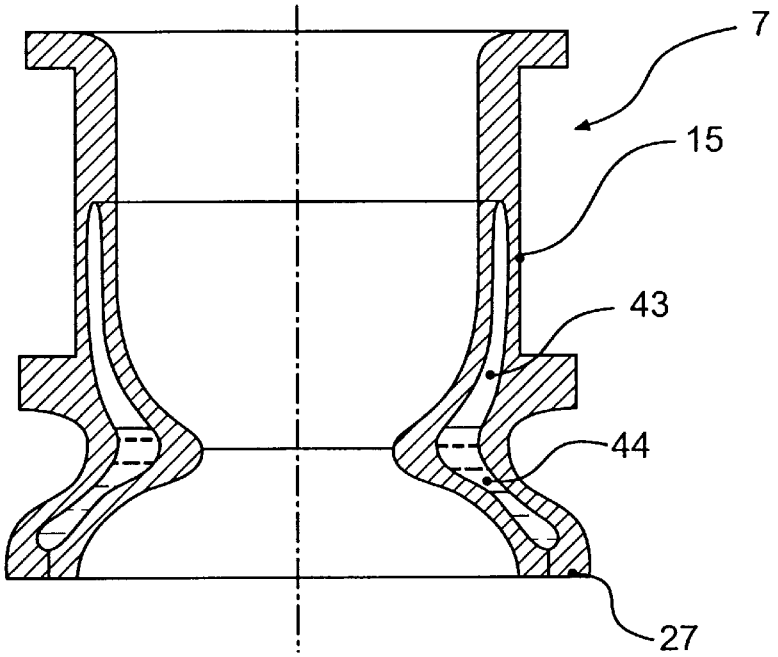
FIG. 7 represents a schematic sectional view of the inlet valve including a space containing a heat-conducting fluid.

Refer now to FIG. 7.

In the engine in accordance with the invention the inlet valve 7 has a large area exposed to the combustion gases with the result that it is important to cool the valve effectively. Likewise, because of the high performance that can be obtained with an engine of the above kind, the exhaust valve can advantageously be rigorously cooled.

In accordance with the invention, the valve can advantageously be made with an elongate annular cavity inside it substantially exposing the shape of the valve and descending to a point near the free end 27 of the valve 7 so as to extend largely inside the cylindrical tubular part 15 of the valve. This cavity is partly filled with a fluid 44 that is a good conductor of heat, for example sodium which is in the liquid state when the valve has reached its operating temperature. In this way heat can be evacuated outwards into an area in which it is easy to cool the valve. Moreover, the large surface area swept by the air during scavenging enables transfer of heat from the inside surface of the inlet valve during combustion to the outside surface of said valve during compression. This transfer can be obtained either by conduction or by convection in the heat-conducting fluid.

A similar cavity can be provided in the exhaust valve in order to convey heat from the lower end of the valve to the water or oil cooling means of the valve.

Note that this technique, using a heat-conducting fluid such as sodium partly filling a cavity within the thickness of the valve and more or less espousing its outside surface and consisting in extracting heat in the hot part of the head of the valve in order to transfer it to the stem of the valve where cooling means are disposed, is known in itself but of very low efficiency. With a valve of conventional shape there is a disproportion between the surface area that receives the heat (the "tulip" or valve head) and the surface area where the heat can be evacuated (the valve stem).

On the other hand, with a tubular valve as used in the invention, these proportions are reversed and there is a very large tubular surface area for evacuating heat extracted from the head of the valve by means of an appropriate cooling system.

Figure 8:
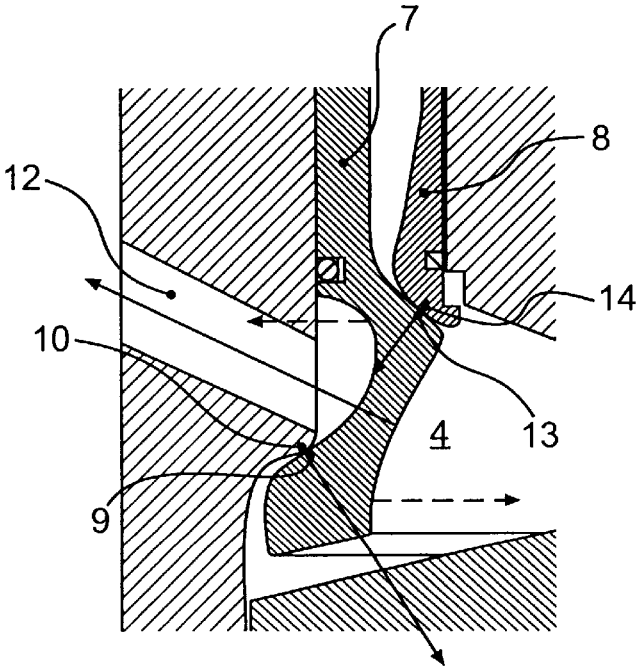
FIG. 8 represents a schematic view of the conjugate profiles of the inlet valve and its seat in one preferred embodiment of the invention.

Refer now to FIG. 8.

In a tubular inlet valve, such as a valve 7, for example, associated with the tubular exhaust valve 8 of which it carries the seat 13, the forces due to the pressure of the gases, especially when the piston is near its top dead centre, are exerted on the inside face of the inlet valve, mainly facing the chamber 4. The valve part above its bearing engagement with the seat 10 will be subjected to tensile stresses and the free end of the valve below this bearing engagement will be subject to compression stresses. The resultant of these forces is exerted on the valve 7 between where it bears on the fixed seat 10 and where it bears on the mobile bearing surface 14 of the exhaust valve 8. The combination of this resultant of forces due to the action of the gases and bearing engagement reaction forces (represented by the solid line arrows) exerts a tilting torque (the forces of which are represented by chain-dotted arrows) on the inlet valve 7 which therefore pivots about its fixed bearing point, i.e. the seat 10, anti-clockwise in FIG. 8.

The conjugate profiles of the bearing surface 9 and the seat 10 of the valve 7 can be calculated allowing for the radial compression strength of the part of the valve under the bearing surface 9 and the radial tensile strength of the part of the valve between the bearing surfaces 9 and 13, so that the bearing surface 9 of the valve 7 bears on its seat 10 at a circular contact line the plane of which is perpendicular to the axis of said valve, and which can roll without sliding of the seat 10 when the pressure of the combustion gases cyclically deforms the valve 7. This effect of rolling without sliding can be obtained by imparting a rounded profile to the surface of the valve at its bearing surface 9 and to the surface of the cylindrical head at the seat 10, whether the valve is a tubular valve of the type defined in the present invention, that is to say one in which the surfaces downstream of the seat form a quasi-isentropic diffuser, or a conventional tubular valve.

In the tubular inlet valve of the invention, which includes a quasi-isentropic diffuser downstream of its seat, the fact that the latter is hollow and has an S-shape profile on opposite sides of its bearing surface 9 lends itself particularly well to obtaining this rolling without sliding of the circular line of contact of the bearing surface 9 on the seat 10, which line will migrate upwards (i.e. towards the cylinder head) in a plane perpendicular to the axis of said valve because of the cyclic deformation of the valve by the pressure of the gases in the combustion chamber. The conjugate profiles of the bearing surface 9 and the seat 10 of the valve can be determined by experiment, seeking to minimise friction and therefore wear of the parts in contact, or by calculation, using the evolution of the thickness and the shape of the valve (and therefore its inertia) as a function of the axial position of the section plane and of the stiffness of the material from which it is made.

What is claimed is:

1. Two-stroke internal combustion engine with loop scavenging comprising:

at least one variable volume working chamber delimited by a cylindrical wall in which a piston slides, a mobile top face of the piston and a fixed cylinder heat, said engine operating in accordance with a two-stroke cycle, with a loop scavenging system via the cylinder head, controlled (a) by at least one inlet valve cooperating with a seat to cause the working chamber to communicate cyclically with an inlet cavity communicating with means for supplying air to the engine and (b) by at least one exhaust valve cooperating with a seat to cause the working chamber to communicate cyclically with an exhaust cavity communicating with a combustion gas exhaust system of the engine, wherein said inlet valve and said exhaust valve are disposed so that the air entering the working chamber through the inlet valve causes scavenging of at least a substantial part of burned gases in the chamber and the evacuation thereof via the exhaust valve, wherein, at least one of said inlet and exhaust valves and (a) a surface of the at least one valve downstream of a bearing surface of said at least one valve, in the direction of flow through the at least one valve (b) a surface of a part extending the seat of said at least one valve, with which said bearing surface cooperates, and also situated downstream of said seat, and (c) are both said surfaces configured when the at least one valve is in a completely opened position so that a fluid flow section increases progressively in the direction of flow to constitute a substantially isentropic divergent diffuser discharging into the cavity downstream of the at least one valve.

2. An engine according to claim 1 wherein a discharge section at a point of entry into said cavity is greater than a geometrical minimal flow section of the at least one valve in a fully open position.

3. An engine according to claim 1:

wherein there is a single inlet valve and a single exhaust valve, wherein said inlet and exhaust valves are coaxial concentric circular cylinders with a common axis and with the inlet valve outside the exhaust valve, wherein the seat of the inlet valve is attached to the cylinder head and oriented so that a pressure of a drive fluid contained in the working chamber exerts a force that tends to press said inlet valve onto its seat, said seat of the inlet valve is in an immediate vicinity of a periphery of an upper part of said cylindrical wall in which the piston slides and in contact with the cylinder head, and wherein said exhaust valve has a tubular part with an inside wall (a) which slides on a fixed hub carried by the cylinder head and (b) which is sealed to said fixed hub by sealing means, and wherein an end of said exhaust valve towards the chamber has a bearing surface coaxial with said tubular part so as to be able to cooperate with said seat of the exhaust valve, said seat of the exhaust valve being formed inside an end facing towards the chamber of said inlet valve, enabling the working chamber to communicate with an exhaust cavity by virtue of an annular space delimited radially by an inside wall of the inlet valve and by an outside wall of the exhaust valve.

4. An engine according to claim 3 further including means for imparting rotation to inlet air passing through the inlet valve.

5. An engine according to claim 1 wherein a ratio between a discharge section where a flow from the at least one valve enters the cavity downstream thereof, in the direction of flow, and a geometrical minimal flow section of the at least one valve in a fully open position, is at least equal to a critical ratio calculated for a valve of a ratio of pressures of a fluid flowing in said at least one valve on either side thereof during normal operation of the engine.

6. An engine according to claim 1 wherein a meridian profile of the surface of the inlet valve downstream of the bearing surface thereof is configured so as progressively to become substantially parallel to a direction of the cylindrical wall of the chamber in which the piston slides.

7. An engine according to claim 1 wherein meridian profiles of an outside surface of the exhaust valve and of an inside surface of the inlet valve downstream of a minimal flow section of said inlet valve are configured at an outlet of an annular passage so as to be substantially parallel to an axis common to said valves.

8. An engine according to claim 1 wherein said inlet cavity communicates with said working chamber via passages inclined to a longitudinal axis and towards both said chamber and said piston so as to reduce a change of direction of an inlet flow of air in a meridian plane of the engine.

9. An engine according to claim 8 wherein said passages which are inclined relative to the axis comprise a passage between two coaxial conical surfaces in the cylinder head in which are disposed, as close as possible to an outlet from said passage, fixed deflector blades adapted to impart to the flow through said passage a rotation component around the axis.

10. An engine according to claim 3 wherein an inside cylindrical surface of the exhaust valve cooperates with a ring forming a track on which slides a seal packing disposed between the central hub and said exhaust valve so as to be able to move laterally relative to said hub and assume a position coaxial with the seat of the exhaust valve disposed in the inlet valve in an event of eccentricity of the fixed hub relative to said seat.

11. An engine according to claim 1 wherein the inlet valve has a shoulder serving as a piston sliding in a cylinder and delimiting a variable volume chamber communicating with a cylindrical variable volume chamber in which slides a piston cooperating with a camshaft in order to raise the inlet valve and wherein said chamber delimited by said piston is connected to a low-pressure oil supply means by a narrow passage having an outlet which is cyclically covered and uncovered by a movement of said piston cooperating with the camshaft so that when said piston is released to return to an initial position thereof after actuation by the cam the outlet is uncovered and places the cavity filled with oil in communication with the low-pressure supply means whereas said outlet is very quickly covered when the piston begins to be moved by the cam to begin to lift the inlet valve.

12. An engine according to claim 1 wherein at least one of the valves is a tubular valve having an elongate internal cavity espousing the shape of the at least one valve and with the internal cavity partially filled with a heat-conducting fluid enabling evacuation of heat to a tubular upper part of the at least one valve.

13. An engine according to claim 1 wherein a bearing surface of the inlet valve and the seat of the inlet valve downstream of a circular line of contact therebetween when the pressure in the chamber is low or nil, are both adapted so that on cyclic deformation of said inlet valve by forces due to a pressure of gases a diameter of the circular line of contact decreases so that the bearing surface of the inlet valve pivots about a line of bearing engagement with the seat of the inlet valve and rolls without sliding thereon.

14. An engine according to claim 13 wherein a surface at a level of the seat of the inlet valve and a facing conjugate surface at a level of the bearing surface of the inlet valve have profiles having a point of inflection, and wherein the line of contact moves in a vicinity of this point of inflection during pressure variations.

15. An engine according to claim 14, wherein the at least one valve is the inlet valve, and wherein a transfer of heat occurs towards an outside surface of the inlet valve which is cooled cyclically by scavenging air.

* * * * *